US005449572A

United States Patent [19]

Ashiya et al.

[11] Patent Number: 5,449,572

[45] Date of Patent: Sep. 12, 1995

[54] ELECTROPHOTOGRAPHIC PHOTORECEPTOR HAVING HIGH MECHANICAL DURABILITY

[75] Inventors: Seiji Ashiya; Masaru Miura, both of Ashigara, Japan

[73] Assignee: Fuji Xerox Co., Ltd., Tokyo, Japan

[21] Appl. No.: 178,133

[22] Filed: Jan. 6, 1994

[30] Foreign Application Priority Data

Jan. 13, 1993 [JP] Japan ..... 5-19488

[51] Int. Cl.[6] ..... G03G 5/087

[52] U.S. Cl. ..... 430/96; 430/66

[58] Field of Search ..... 430/58, 59, 96, 66

[56] References Cited

U.S. PATENT DOCUMENTS 5,080,987 1/1992 Odell et al. ..... 430/48
5,254,423 10/1993 Mayama et al. ..... 430/96
5,312,708 5/1994 Terrell et al. ..... 430/96

FOREIGN PATENT DOCUMENTS 60-172045 9/1985 Japan .
62-208053 9/1987 Japan .

*Primary Examiner*—John Goodrow
*Attorney, Agent, or Firm*—Oliff & Berridge

[57] ABSTRACT

An electrophotographic photoreceptor comprising a conductive substrate having thereon a photosensitive layer is disclosed, said photosensitive layer containing, as a binder resin, a polycarbonate resin comprising at least a repeating unit represented by formula (I):

(I)

wherein $R_1$, $R_2$, $R_3$, and $R_4$ each represent a hydrogen atom, a halogen atom, an alkyl group having from 1 to 5 carbon atoms, a cycloalkyl group having from 5 to 7 carbon atoms or a phenyl group; and $R_5$ and $R_6$ are taken together to form a 5- to 8-membered carbonaceous ring substituted with at least two alkyl groups each having from 1 to 5 carbon atoms. The photoreceptor has high mechanical durability and satisfactory surface smoothness, resistance against reduction in image quality and sensitivity, and stability against environmental change and repeated use.

3 Claims, No Drawings

ELECTROPHOTOGRAPHIC PHOTORECEPTOR HAVING HIGH MECHANICAL DURABILITY

FIELD OF THE INVENTION

This invention relates to an electrophotographic photoreceptor widely applicable in the field of applied electrophotography, such as an electrophotographic copying machine, a laser beam printer, a laser facsimile, etc.

BACKGROUND OF THE INVENTION

In electrophotographic photoreceptors, inorganic photoconductive materials, such as selenium, cadmium sulfide , and zinc oxide, have hitherto been employed. As compared with the inorganic photoconductive materials, organic photoconductive materials, such as polyvinylcarbazole, oxadiazole and phthalocyanine, have met difficulty in putting to practical use due to their low sensitivity, though advantageous from the viewpoint of environmental conservation and high productivity. Several approaches for increasing sensitivity of organic photoconductive materials have been proposed to date. Among the proposals, a so-called separate function type photoreceptor having a laminate structure composed of a charge generating layer and a charge transporting layer is an effective one and has already been put to practical use.

An electrophotographic photoreceptor, as a matter of course, is required to have prescribed sensitivity, electrophotographic characteristics, and optical characteristics in conformity with an electrophotographic process adopted. In particular, an uppermost layer (i.e., the layer farthest from a conductive substrate) of a photosensitive layer in a repeatedly usable photoreceptor is demanded to have durability against electrical or mechanical outer force directly imposed thereto through steps of corona discharge, toner development, transfer to paper, and cleaning. More specifically, the uppermost layer (hereafter, sometimes referred to as surface layer) should be resistant against reduction in sensitivity or initial potential or increase in residual potential due to deterioration by ozone generated during corona charging and against wear or scratching due to surface sliding.

Further, adhesion of paper dust to a photoreceptor due to contact with paper is one of causes of image diffusion in a high temperature, and remaining of a toner on a photoreceptor due to toner filming or insufficient cleaning seriously impairs image quality. Therefore, it has been demanded to form a surface layer which is hardly contaminated with paper dust or toner particles and also which is easily cleared of such contaminants.

In order to meet the above demand, various improvements have been added. For example, it is known that polycarbonate resins of bisphenol A type, polystyrene resins, polyacrylic resins, and the like are known to serve as a binder resin effective to improve charging characteristics, photosensitivity, residual potential, and durability against repeated use.

However, when used in an electrophotographic copying machine, the electrophotographic photoreceptors using these resins as a binder tend to suffer from scratches or wear through sliding with a magnetic brush or a cleaning blade.

On the other hand, workability in copying operation and quality of the resulting image are also influenced by uniformity of the coating layer(s) inclusive of the surface layer of a photoreceptor. Accordingly, the coating layer of a photoreceptor is required to have a uniform thickness and a smooth and homogeneous surface for assuring high image quality and satisfactory workability. In other words, surface defects, such as orange peel, pin holes, coating streaks, solvent cracks, etc., attributed to the composition of a coating composition or coating or drying conditions give rise to serious problems for copying characteristics and the production technique.

Use of a surface active agent is known effective to improve surface properties or slipping properties. In a suspension coating system, it is also effective to improve dispersibility and dispersion stability of the suspensoid. In a solution coating system, it is effective to improve solubility of the solute and coating properties of the solution. However, unless properly selected, a surface active agent often causes troubles, such as poor adhesion between layers, disorders due to denaturing, or poor moisture resistance.

In order to overcome the troubles associated with the use of a surface active agent, improvement of a polycarbonate resin of bisphenol A type (see JP-A-60-172045, the term "JP-A" as used herein means "an unexamined published Japanese patent application"), use of a siloxane-blocked copolymer of a polycarbonate resin (see U.S. Pat. No. 5,080,987) and a combined use of a polycarbonate resin with a comb type silicone-grafted polymer (see JP-A-62-208053) have been suggested. However, any of these binder resins still fails to provide sufficient surface strength and smoothness, and the resulting photoreceptor has poor resistance to wear and scratching and undergoes reductions in image quality on repeated use and in sensitivity due to wear of the surface.

SUMMARY OF THE INVENTION

An object of the present invention is to provide an electrophotographic photoreceptor which has high mechanical durability and satisfactory surface smoothness and hardly suffers from reductions in image quality and sensitivity.

Another object of the present invention is to provide an electrophotographic photoreceptor having excellent stability against environmental change and repeated use.

A further object of the present invention is to provide an electrophotographic photoreceptor which can be prepared by using a photosensitive layer-forming coating composition having a long pot life (preservability).

As a result of extensive investigations, the present inventors have found that the above objects are accomplished by using a specific polycarbonate resin as a binder resin for a photosensitive layer.

The present invention provides an electrophotographic photoreceptor comprising a conductive substrate having thereon a photosensitive layer containing a polycarbonate resin comprising at least a repeating unit represented by formula (I):

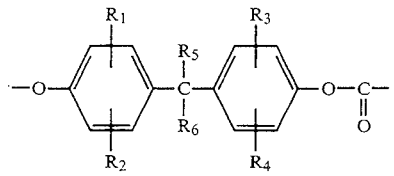

(I)

wherein $R_1$, $R_2$, $R_3$, and $R_4$ each represent a hydrogen atom, a halogen atom, an alkyl group having from 1 to 5 carbon atoms, a cycloalkyl group having from 5 to 7 carbon atoms or a phenyl group; and $R_5$ and $R_6$ are taken together to form a 5-to 8-membered carbonaceous ring substituted with at least two alkyl groups each having from 1 to 5 carbon atoms.

DETAILED DESCRIPTION OF THE INVENTION

Preferred examples of $R_1$, $R_2$, $R_3$ and $R_4$ include a chlorine atom and a methyl group. Of them, a methyl group is most preferred.

Preferred examples of the alkyl group which is the substituent on the carbonaceous ring in $R_5$ and $R_6$ include a methyl group and an ethyl group. Of them, a methyl group is most preferred.

The substituent position of the alkyl group which is the substituent on the carbonaceous ring in $R_5$ and $R_6$ is, while not limiting, preferably farthest from a carbon atom on the main chain of formula (I) (i.e., a carbon atom connecting $R_5$ and $R_6$) from the standpoint of steric hindrance.

The conductive substrate which can be used in the present invention includes, while not limiting, metals, e.g., aluminum, stainless steel, copper, and nickel; and insulating materials, such as a polyester film, a phenol resin pipe or a paper tube, having thereon a conductive layer of aluminum, copper, nickel, palladium, tin oxide, indium oxide, etc.

If desired, the conductive substrate may be subjected to various surface treatments as far as the image quality is not impaired. For example, it is subjected to an oxidation treatment, a chemical treatment, a coloring treatment or a non-specular finish, such as surface graining.

If desired, a subbing layer may be provided between a conductive substrate and a photosensitive layer. A subbing layer functions to block injection of unnecessary charges from a conductive substrate into a photosensitive layer on charging of the photosensitive layer. It also serves as an adhesive layer for adhesion between the conductive substrate and the photosensitive layer. In some cases, a subbing layer is effective to prevent light reflection or interference of the conductive substrate.

Materials for constituting a subbing layer include polyamide resins, polyurethane resins, cellulose, nitrocellulose, sodium casein, polyvinyl alcohol, polyvinylpyrrolidone, polyacrylamide, and anodized aluminum. A subbing layer usually has a thickness of from 0.01 to 20 μm, preferably 0.05 to 2 μm.

The photosensitive layer may have either a single layer structure comprising a binder resin having dispersed therein a photoconductive material and a charge transporting material or a separate function type laminate structure composed of a charge generating layer and a charge transporting layer, with the latter type being preferred. In either case, the photosensitive layer essentially contains a polycarbonate resin comprising the repeating unit represented by formula (I) as a binder resin.

Specific examples of the repeating unit represented by formula (I) are shown below.

I-1:

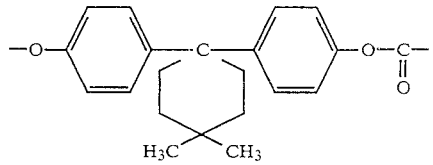

I-2:

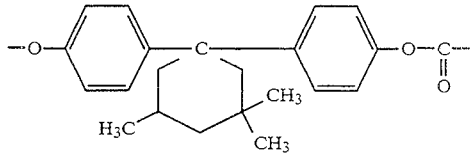

I-3:

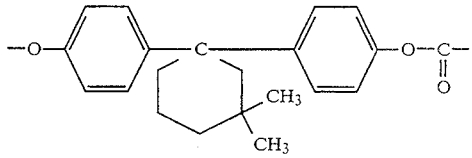

I-4:

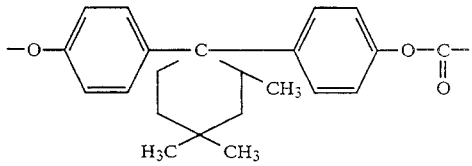

I-5:

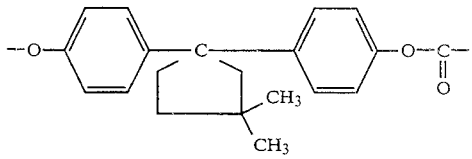

I-6:

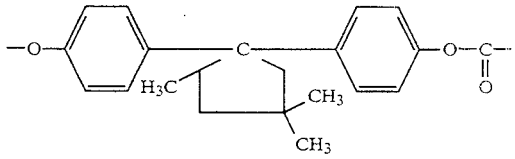

Of them, Repeating Unit Nos. I-1, I-2 and I-3 are preferred.

The polycarbonate resin according to the present invention may be either a homopolymer of the repeating unit of formula (I) or a copolymer comprising two or more repeating units of formula (I). In addition, copolymers comprising the repeating unit of formula (I) and a repeating unit represented by formula (II) shown below are also included in the polycarbonate resin of the present invention.

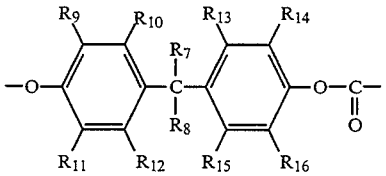

(II)

wherein $R_7$ and $R_8$ each represent a hydrogen atom, a substituted or unsubstituted alkyl group having from 1 to 6 carbon atoms, a substituted or unsubstituted alicyclic group having from 5 to 12 carbon atoms, an aryl group having from 6 to 12 carbon atoms or a halogen atom; or $R_7$ and $R_8$ are taken together to form an alicyclic group having from 5 to 12 carbon atoms which may be substituted; and $R_9$, $R_{10}$, $R_{11}$, $R_{12}$, $R_{13}$, $R_{14}$, $R_{15}$, and $R_{16}$ each represent a hydrogen atom, an alkyl group having from 1 to 6 carbon atoms or a halogen atom.

The copolymerization ratio of the repeating unit of formula (I) to the repeating unit of formula (II) may be in the range of 10:90 to 100:0.

Preferred examples of $R_7$ and $R_8$ include a methyl group, a phenyl group and a cyclohexane ring.

Preferred examples of $R_9$, $R_{10}$, $R_{11}$, $R_{12}$, $R_{13}$, $R_{14}$, $R_{15}$ and $R_{16}$ include a methyl group and a phenyl group.

Specific examples of the repeating unit of formula (II) are shown below.

II-1:

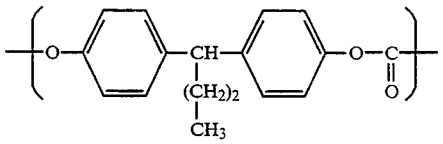

II-2:

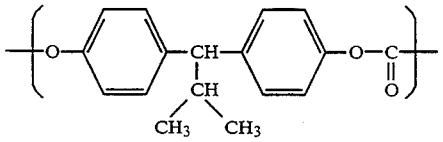

II-3:

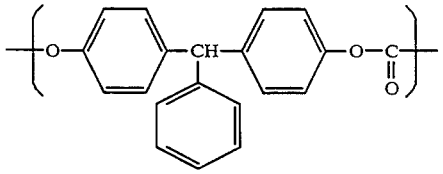

II-4:

-continued

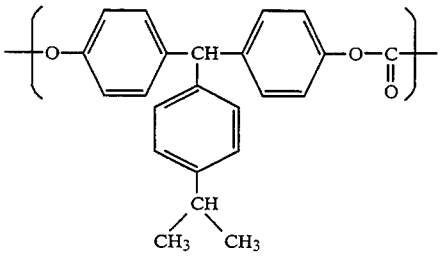

II-5:

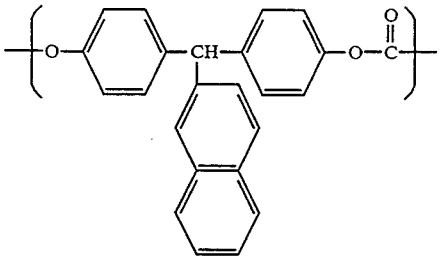

II-6:

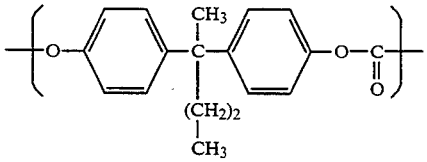

II-7:

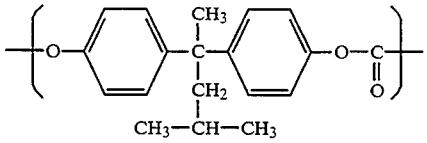

II-8:

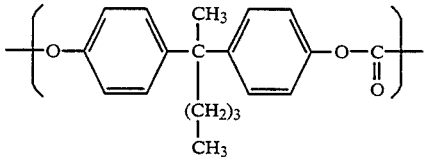

II-9:

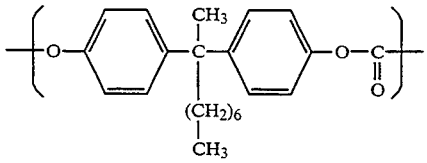

II-10:

-continued
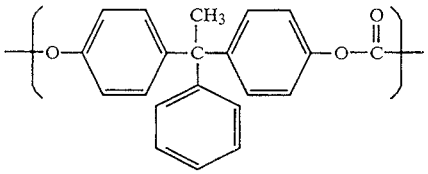
II-11:
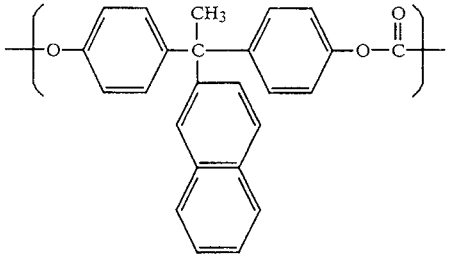
II-12:
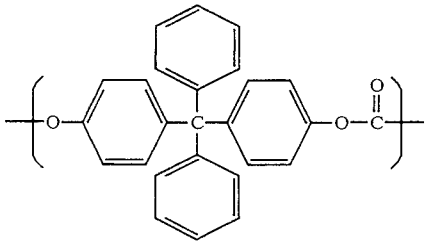
II-13:
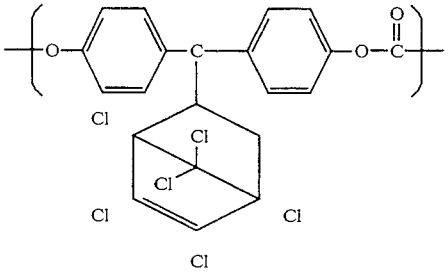
II-14:
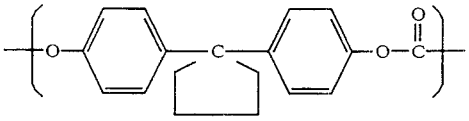
II-15:
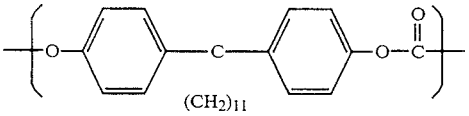
II-16:
-continued
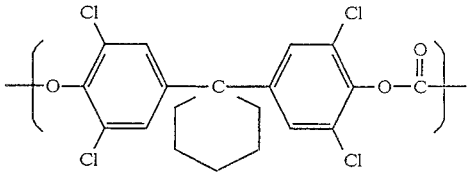
II-17:
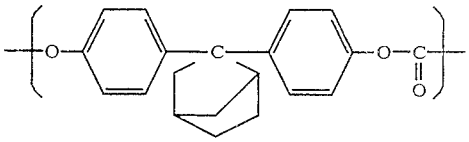
II-18:
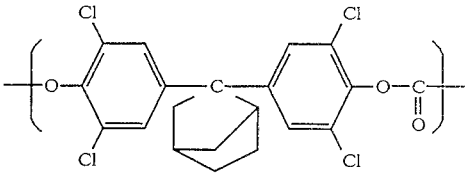
II-19:
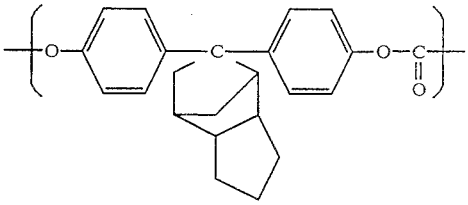
II-20:
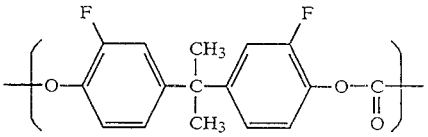
II-21:
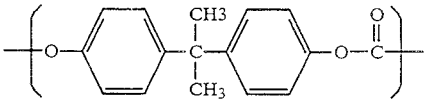
II-22:
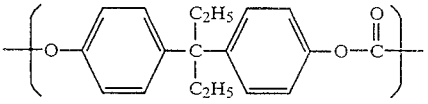
II-23:

-continued

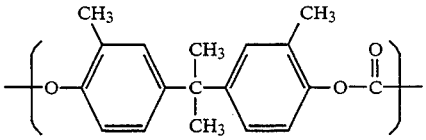

II-24:

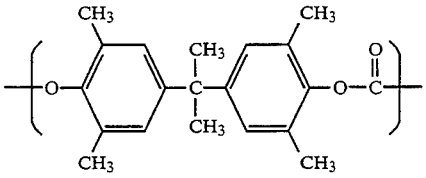

II-25:

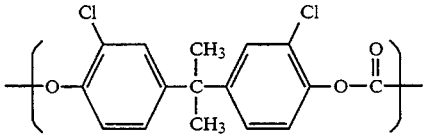

II-26:

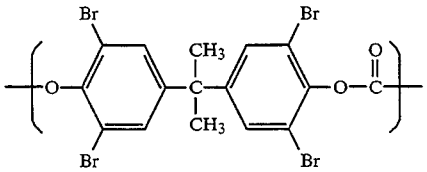

II-27:

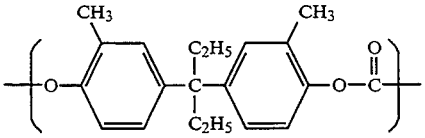

II-28:

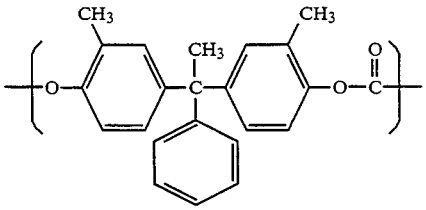

II-29:

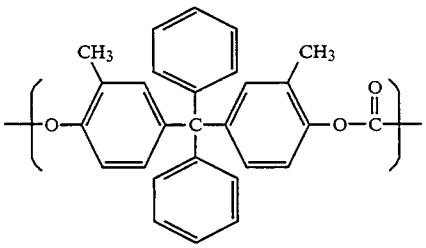

-continued

II-30:

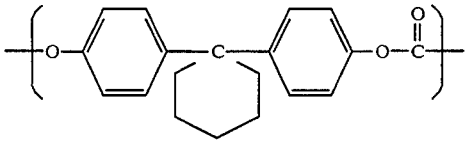

II-31:

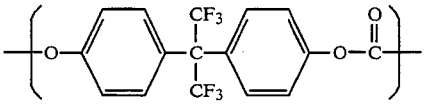

Of them, Repeating Unit Nos. II-10, II-12, II-21, II-23 and II-30 are preferred. Repeating Unit No. II-30 is most preferred.

The polycarbonate resin comprising the repeating unit of formula (I) usually has a weight average molecular weight of from 10,000 to 500,000, and preferably from 50,000 to 200,000.

The above-mentioned polycarbonate resin may be used as a binder resin either alone or, if desired, in combination with other known binder resins. The amount of polycarbonate resin according to the present invention may be at least 10 wt %, preferably at least 50 wt % of the total weight of the binder resin. Examples of binder resins which can be used in combination include polyester resins, acrylic resins, methacrylic resins, polyvinyl chloride, polyvinylidene chloride, polystyrene, polyvinyl acetate, styrene copolymer resins (e.g., styrene-butadiene copolymers and styrene-methyl methacrylate copolymers), acrylonitrile copolymer resins (e.g., vinylidene chloride-acrylonitrile copolymers), vinyl chloride-vinyl acetate copolymers, vinyl chloride-vinyl acetate-maleic anhydride copolymers, silicone resins, silicone-alkyd resins, phenolic resins (e.g., phenol-formaldehyde resins and cresol-formaldehyde resins), styrene-alkyd resins, poly-N-vinylcarbazole, polyvinyl butyral resins, polyvinyl formal resins, and polyhydroxystyrene. These binder resins may be used in combination of two or more thereof.

A single-layered photosensitive layer is formed by coating a dispersion of a photoconductive material and a charge transporting material in the above-mentioned binder resin.

The photoconductive materials which can be used in the present invention include inorganic photoconductive substances, such as selenium and its alloys and cadmium sulfide; and organic pigments, such as phthalocyanine pigments, azo pigments, quinacridone pigments, indigo pigments, perylene pigments, polycyclic quinone pigments, anthanthrone pigments, and benzimidazole pigments. These photoconductive materials are used in the form of fine particles having an average particle size of at least 0.01 μm, preferably 0.1 to 1.0 μm.

The charge transporting materials which can be used in the present invention include electron-attracting substances, such as 2,4,7-trinitrofluorenone and tetracyanoquinodimethane; and electron-donating substances, such as heterocyclic compounds, e.g., carbazole, indole, imidazole, oxazole, pyrazole, oxadiazole, pyrazoline, and thiadiazole, aniline derivatives, hydrazone compounds, aromatic amine derivatives, stilbene derivatives, and polymers containing the residue of these compounds in the main chain or side chain thereof. These charge transporting materials may be used either individually or in combination of two or more thereof.

Of the above-enumerated charge transporting materials preferred are N,N,N',N'-tetraphenylbenzidine compounds represented by formula (III) shown below and triphenylamine compounds represented by formula (IV) shown below.

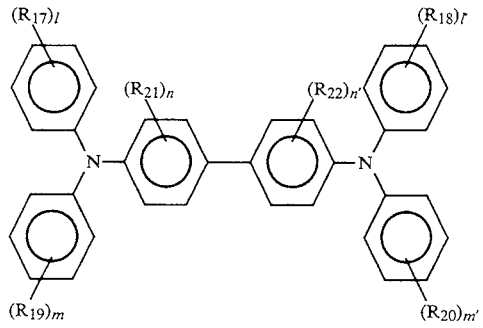

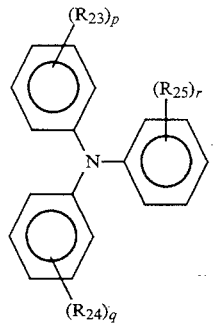

wherein $R_{17}$, $R_{18}$, $R_{19}$, and $R_{20}$ each represent an alkyl group having from 1 to 5 carbon atoms, a hydroxyl group, an alkoxy group having from 1 to 5 carbon atoms or a halogen atom; $R_{21}$ and $R_{22}$ each represent an alkyl group having from 1 to 5 carbon atoms; $R_{23}$, $R_{24}$, and $R_{25}$ each represent an alkyl group having from 1 to 5 carbon atoms, an alkoxy group having from 1 to 5 carbon atoms, a hydroxyl group, a phenyl group which may be substituted, a biphenyl group which may be substituted or a pyrene group which may be substituted; l, l', m, m', p, q, and r each represent 0 or an integer of from 1 to 5; and n and n' each represent 0 or a integer of from 1 to 4.

Specific examples of the substituted or unsubstituted phenyl, biphenyl and pyrene group in $R_{23}$, $R_{24}$ and $R_{23}$ are shown below.

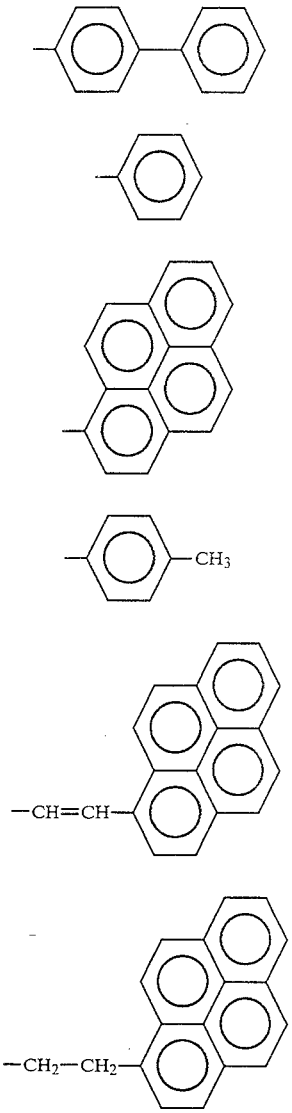

Specific examples of the N,N,N', N'-tetraphenylbenzidine compounds represented by formula (III) are shown in Table 1 below.

TABLE 1

| Compound No. | $R_{17}$ | $R_{18}$ | $R_{19}$ | $R_{20}$ | $R_{21}$ | $R_{22}$ |
|---|---|---|---|---|---|---|
| III-1 | 3-$CH_3$ | 3-$CH_3$ | — | — | — | — |
| III-2 | 3,4-$CH_3$ | 3,4-$CH_3$ | — | — | — | — |
| III-3 | 4-$CH_3$ | 4-$CH_3$ | — | — | 3-$CH_3$ | 3-$CH_3$ |
| III-4 | 4-$CH_3$ | 4-$CH_3$ | 3-$CH_3$ | 3-$CH_3$ | 3-$CH_3$ | 3-$CH_3$ |
| III-5 | 4-$CH_3$ | 4-$CH_3$ | 2,3-$CH_3$ | 2,3-$CH_3$ | 3-$CH_3$ | 3-$CH_3$ |
| III-6 | 4-$CH_3$ | 4-$CH_3$ | 2,3-$CH_3$ | 2,3-$CH_3$ | — | — |
| III-7 | 4-$C_2H_5$ | 4-$C_2H_5$ | — | — | — | — |
| III-8 | 4-$C_2H_5$ | 4-$C_2H_5$ | 4-$CH_3$ | 4-$CH_3$ | — | — |
| III-9 | 4-$CH_3$ | 4-$CH_3$ | 4-$CH_3$ | 4-$CH_3$ | 3-$CH_3$ | 3-$CH_3$ |
| III-10 | 2,4-$CH_3$ | 2,4-$CH_3$ | 4-$CH_3$ | 4-$CH_3$ | 3-$CH_3$ | 3-$CH_3$ |
| III-11 | 2,4-$CH_3$ | 2,4-$CH_3$ | 4-$CH_3$ | 4-$CH_3$ | — | — |
| III-12 | 4-$CH_3$ | 4-$CH_3$ | 2-$CH_3$ | 2-$CH_3$ | 3-$CH_3$ | 3-$CH_3$ |
| III-13 | 3,4-$CH_3$ | 3,4-$CH_3$ | 4-$C_2H_5$ | 4-$C_2H_5$ | 3-$CH_3$ | 3-$CH_3$ |
| III-14 | 3-$CH_3$ | 3-$CH_3$ | — | — | — | — |
| III-15 | — | — | — | — | — | — |
| III-16 | 4-$CH_3$ | 4-$CH_3$ | 4-$C_2H_5$ | 4-$C_2H_5$ | 3-$CH_3$ | 3-$CH_3$ |

TABLE 1-continued

| Compound No. | $R_{17}$ | $R_{18}$ | $R_{19}$ | $R_{20}$ | $R_{21}$ | $R_{22}$ |
|---|---|---|---|---|---|---|
| III-17 | 4-$CH_3$ | 4-$CH_3$ | 4-$CH_3$ | 4-$CH_3$ | — | — |
| III-18 | 4-OH | 4-OH | — | — | — | — |
| III-19 | 3-Cl | 3-Cl | — | — | — | — |

Of them, Compound Nos. III-1, III-16 and III-9 are preferred.

Specific examples of the triphenylamine compounds represented by formula (IV) are shown in Table 2 below.

TABLE 2

| Compound No. | $R_{23}$ | $R_{24}$ | $R_{25}$ |
|---|---|---|---|
| IV-1 | 4-$CH_3$ | 4-$CH_3$ | 4-$CH_3$ |
| IV-2 | 4-$CH_3$ | — | 4-$CH_3$ |
| IV-3 | 4-$CH_3$ | 2-$CH_3$ | 4-$CH_3$ |
| IV-4 | 4-$C_2H_5$ | 4-$C_2H_5$ | 4-$C_2H_5$ |
| IV-5 | 4-$C_2H_5$ | — | 4-$CH_3$ |
| IV-6 | — | — | 3-$CH_3$ |
| IV-7 | 4-$OCH_3$ | 2-$CH_3$ | 4-$OCH_3$ |
| IV-8 | — | — | — |

Of them, Compound Nos. IV-1 and IV-8 are preferred.

The amount of the photoconductive material fine particle to be used in a single-layered photoconductive layer ranges from 1 to 50 parts by weight per 100 parts by weight of the polycarbonate resin, and that of the charge transporting material ranges from 30 to 150 parts by weight per 100 parts by weight of the polycarbonate resin. The single-layered photoconductive layer usually has a thickness of from 5 to 50 μm, and preferably from 10 to 30 μm.

In the case of a laminate type photoconductive layer, the polycarbonate resin is incorporated into any of constituting layers inclusive of a charge generating layer and a charge transporting layer. From the standpoint of response properties, the polycarbonate resin is preferably incorporated into a charge transporting layer irrespective of the order of laminating a plurality of layers. From the viewpoint of prevention of film thickness reduction, it is preferably incorporated into the uppermost layer of the photosensitive layer. Since the polycarbonate resin of the present invention is capable of dispersing a charge transporting material satisfactorily, production of a photoreceptor containing the polycarbonate resin in its charge transporting layer involves no technical problem. Accordingly, it is particularly preferred in the present invention that a charge transporting layer containing the polycarbonate resin constitutes the uppermost layer of a laminate type photoconductive layer.

The charge generating layer of a laminate type photoconductive layer comprises fine particles of the above-mentioned photoconductive material dispersed and bound by the polycarbonate resin comprising the repeating unit of formula (I) and/or other binder resins, such as polyvinyl acetate, polyacrylates, polymethacrylates, polyesters, polycarbonates, polyvinyl acetoacetal, polyvinyl propional, polyvinyl butyral, phenoxy resins, epoxy resins, urethane resins, cellulose esters, cellulose ethers, etc.

The photoconductive material fine particle is usually used in an amount of from 30 to 600 parts by weight per 100 parts by weight of the binder resin. The thickness of the charge generating layer is usually from 0.1 to 1 μm, and preferably from 0.15 to 0.6 μm.

The charge transporting layer comprises the above-mentioned charge transporting material dispersed and bound by a binder resin.

The charge transporting material is usually used in an amount of from 20 to 150 parts by weight, and preferably from 50 to 110 parts by weight, per 100 parts by weight of the binder resin. The thickness of the charge transporting layer is usually from 5 to 50 μm, and preferably from 10 to 45 μm.

If desired, the charge transporting layer may further contain known additives for improving film-forming properties, flexibility, coating properties, and the like, such as plasticizers, antioxidants, ultraviolet absorbents, and levelling agents.

The present invention will now be illustrated in greater detail with reference to Examples, but it should be understood that the present invention should not be construed as being limited thereto. All the parts are by weight unless otherwise indicated.

EXAMPLE 1

A solution consisting of 10 parts of a zirconium compound (Orgatics ZC540 produced by Matsumoto Seiyaku K.K.), 1 part of a silane compound (A 1110 produced by Nippon Unicar Co., Ltd.), 40 parts of isopropyl alcohol, and 20 parts of butyl alcohol was coated on an aluminum substrate by dip coating and dried by heating at 120° C. for 10 minutes to form a subbing layer having a thickness of 0.5 μm.

One part of chlorogallium phthalocyanine crystal was mixed with 1 part of a vinyl chloride-vinyl acetate copolymer resin (VMCH produced by Union Carbide Co.) and 100 parts of n-butyl acetate, and the mixture was dispersed in a paint shaker together with glass beads for 1 hour. The resulting coating composition was dip-coated on the subbing layer and dried by heating at 100° C. for 10 minutes to form a charge generating layer having a thickness of 0.15 μm.

In 20 parts of monochlorobenzene were dissolved 2 parts of a homopolymer of Repeating Unit No. I-2 (weight average molecular weight (Mw): 129,000) and 2 parts of Compound No. III-1, and the resulting coating composition was dip-coated on the charge generating layer and dried by heating at 120° C. for 1 hour to form a charge transporting layer having a thickness of 20 μm.

The resulting electrophotographic photoreceptor was evaluated with a remodeled laser printer scanner (a remodeled machine of XP-11 manufactured by Fuji Xerox Co., Ltd.) under an ordinary temperature and ordinary humidity condition (20° C. 40% RH) as follows The photoreceptor was charged by means of a scorotron discharger at a grid voltage of −700 V (process A). One second later, the photoreceptor was exposed to light of 5 erg/cm$^2$ by means of a semiconductor laser of 780 nm (process B). Three seconds later, it was exposed to red LED light of 50 erg/cm$^2$ for destaticizing (process C). The surface voltage of the photoreceptor was measured for each of processes A, B and C to obtain $V_H$, $V_L$ or $V_{RP}$, respectively. The same measurements were conducted after repeating these electrophotographic processes 5000 times.

Further, in order to evaluate environmental stability of electrophotographic characteristics, the same measurements were conducted under a low temperature and low humidity condition (10° C., 15% RH) and a high temperature and high humidity condition (28° C., 85% RH) to determine changes in potential in each process between these conditions.

Then, the photoreceptor was mounted on a laser printer (XP-11), and 10,000 copies were taken under a high temperature and high humidity condition (28° C., 85% RH). The image quality of the copies obtained after the running test was evaluated.

The results obtained are shown in Table 3 below.

EXAMPLE 2

An electrophotographic photoreceptor was prepared in the same manner as in Example 1, except for using 2 parts of a homopolymer of Repeating Unit No. I-3 (Mw: 90,000; a product of Bayer A.G.) as a binder resin, using 2 parts of Compound No. III-16 as a charge transporting material, and replacing monochlorobenzene as a solvent with tetrahydrofuran. The resulting photoreceptor was evaluated in the same manner as in Example 1, and the results obtained are shown in Table 3.

EXAMPLE 3

An electrophotographic photoreceptor was prepared in the same manner as in Example 1, except for using 1.2 parts of a homopolymer of Repeating Unit No. I-2 (Mw: 129,000; a product of Bayer A.G.) and 0.8 part of a homopolymer of Repeating Unit No. II-23 (Mw: 130,000; a product of Mitsubishi Gas Chemical Industries, Ltd.) as binder resins and using 1 part of Compound No. III-16 and 1 part of Compound No. IV-1 as charge transporting materials. The resulting photoreceptor was evaluated in the same manner as in Example 1, and the results obtained are shown in Table 3.

COMPARATIVE EXAMPLE 1

An electrophotographic photoreceptor was prepared in the same manner as in Example 1, except for using 2 parts of a homopolymer of Repeating Unit No. II-30 (Mw: 90,000; viscosity-average molecular weight: 39,000; "Yupiron Z-400" produced by Mitsubishi Gas Chemical Industries, Ltd.) as a binder resin and using 2 parts of Compound No. III-1 as a charge transporting material. The resulting photoreceptor was evaluated in the same manner as in Example 1, and the results obtained are shown in Table 3.

TABLE 3

| Example No. | Initial Stage $V_H$ (V) | Initial Stage $V_L$ (V) | Initial Stage $V_{RP}$ (V) | After 5000 Cycles $V_H$ (V) | After 5000 Cycles $V_L$ (V) | After 5000 Cycles $V_{RP}$ (V) | Environmental Stability $\Delta V_H$ (V) | Environmental Stability $\Delta V_L$ (V) | Environmental Stability $\Delta V_{RP}$ (V) | Image Quality After Obtaining 10000 Copies |
|---|---|---|---|---|---|---|---|---|---|---|
| Example 1 | −680 | −120 | −10 | −690 | −130 | −10 | 10 | 10 | 5 | * |
| Example 2 | −670 | −120 | −10 | −680 | −120 | −10 | 10 | 5 | 5 | * |
| Example 3 | −680 | −100 | −10 | −680 | −110 | −10 | 5 | 5 | 5 | * |
| Compar. Example 1 | −670 | −130 | −10 | −650 | −140 | −30 | 20 | 10 | 10 | ** |

Note:
*: No image defects (white or black streaks and white or black spots) developed.
**: Many fine black streaks developed.

The electrophotographic photoreceptor according to the present invention is excellent in charge retention and stability against environmental change and repeated use. Therefore, variations in sensitivity and chargeability due to change of environmental conditions or repeated use can be reduced. Since the photoreceptor of the invention is also excellent in mechanical characteristics, wear of the surface layer due to abrasion with a cleaning blade, etc. is minimized, and the surface layer hardly suffers from scratches which will influence image quality. In other words, the photoreceptor exhibits high durability. Further, as compared with photoreceptors using conventional binder resins, the photoreceptor of the invention exhibits satisfactory response properties and is therefore sufficiently applicable to high-speed electrophotographic processing.

In addition, the polycarbonate resin according to the present invention has excellent solubility in organic solvents and also high solubility in non-halogen type solvents, such as 1,4-dioxane and tetrahydrofuran. Therefore, a coating composition containing the polycarbonate resin of the invention can be prepared by using these solvents without difficulty, thus reducing environmental pollution. The coating composition exhibits excellent stability with time, undergoing no white turbidity when preserved for an extended period of time. Thus, development of coating defects is greatly suppressed, thereby markedly improving productivity of an electrophotographic photoreceptor.

While the invention has been described in detail and with reference to specific examples thereof, it will be apparent to one skilled in the art that various changes and modifications can be made therein without departing from the spirit and scope thereof.

What is claimed is:

1. An electrophotographic photoreceptor comprising a conductive substrate having thereon a photosensitive layer containing, as a binder resin, a polycarbonate resin comprising at least a repeating unit represented by formula (I):

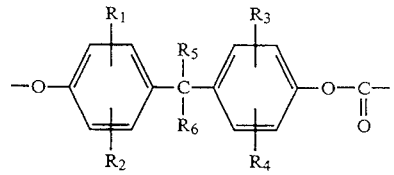

(I)

wherein $R_1$, $R_2$, $R_3$, and $R_4$ each represent a hydrogen atom, a halogen atom, an alkyl group having from 1 to 5 carbon atoms, a cycloalkyl group having from 5 to 7 carbon atoms or a phenyl group; and $R_5$ and $R_6$ are taken together to form a 5- to 8-membered carbonaceous ring substituted with at least two alkyl groups each having from 1 to 5 carbon atoms.

2. An electrophotographic photoreceptor as claimed in claim 1, wherein said polycarbonate resin is a homopolymer of said repeating unit represented by formula (I), a copolymer of two or more of said repeating units represented by formula (I) or a copolymer comprising said repeating unit represented by formula (I) and a repeating unit represented by formula (II):

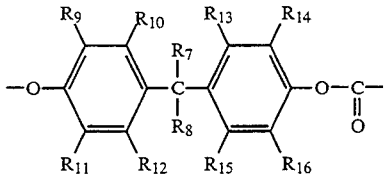

(II)

wherein $R_7$ and $R_8$ each represent a hydrogen atom, a substituted or unsubstituted alkyl group having from 1 to 6 carbon atoms, a substituted or unsubstituted alicyclic group having from 5 to 12 carbon atoms, an aryl group having from 6 to 12 carbon atoms or a halogen atom; or $R_7$ and $R_8$ are taken together to form an alicyclic group having from 5 to 12 carbon atoms which may be substituted; and $R_9$, $R_{10}$, $R_{11}$, $R_{12}$, $R_{13}$, $R_{14}$, $R_{15}$, and $R_{16}$ each represent a hydrogen atom, an alkyl group having from 1 to 6 carbon atoms or a halogen atom.

3. An electrophotographic photoreceptor as claimed in claim 1, wherein said polycarbonate resin is present in an uppermost layer of said photosensitive layer.

* * * * *